United States Patent [19]

Elg

[11] Patent Number: 4,636,616

[45] Date of Patent: Jan. 13, 1987

[54] ELECTRICALLY HEATED RADIATOR WITH HEAT ACCUMULATING PROPERTIES

[76] Inventor: Karl G. H. Elg, Lorenborgsgatan 3A, 217 61 Malmö , Sweden

[21] Appl. No.: 632,108

[22] Filed: Jul. 18, 1984

[30] Foreign Application Priority Data

Jul. 19, 1983 [SE] Sweden ..... 8304035

[51] Int. Cl.[4] ..... H05B 1/02; F24H 7/02

[52] U.S. Cl. ..... 219/365; 126/400; 165/18; 219/341; 219/367; 219/378

[58] Field of Search ..... 219/378, 365, 341, 325, 219/326, 367; 165/10 A, 18; 126/400

[56] References Cited

U.S. PATENT DOCUMENTS

| | | | |
|---|---|---|---|
| 2,022,812 | 12/1935 | Roe | 219/378 X |
| 3,532,856 | 10/1970 | Collins | 219/365 X |
| 3,884,295 | 5/1975 | Laing et al. | 219/378 X |
| 4,473,740 | 9/1984 | Ellis | 219/365 X |

FOREIGN PATENT DOCUMENTS

| | | | |
|---|---|---|---|
| 0017476 | 10/1980 | European Pat. Off. . | |
| 410308 | 2/1925 | Fed. Rep. of Germany | 219/341 |
| 1440451 | 10/1969 | Fed. Rep. of Germany | 219/378 |
| 2020211 | 11/1971 | Fed. Rep. of Germany . | |
| 1579727 | 12/1971 | Fed. Rep. of Germany . | |
| 2263257 | 6/1974 | Fed. Rep. of Germany | 219/378 |
| 1966873 | 1/1975 | Fed. Rep. of Germany . | |
| 940879 | 6/1948 | France | 219/341 |
| 959414 | 9/1949 | France | 219/341 |
| 1005539 | 12/1951 | France | 165/10 A |
| 1237126 | 6/1960 | France | 219/341 |
| 1475554 | 2/1967 | France | 219/378 |
| 79918 | 5/1919 | Switzerland | 219/378 |
| 782137 | 9/1957 | United Kingdom . | |
| 1038390 | 8/1966 | United Kingdom . | |
| 1231400 | 5/1971 | United Kingdom . | |
| 1375545 | 11/1974 | United Kingdom . | |
| 1435831 | 5/1976 | United Kingdom . | |
| 1509761 | 5/1978 | United Kingdom . | |
| 2097912 | 11/1982 | United Kingdom . | |

*Primary Examiner*—Anthony Bartis

*Attorney, Agent, or Firm*—Schwartz, Jeffery, Schwaab, Mack, Blumenthal & Evans

[57] ABSTRACT

This invention relates to an electrically heated radiator with heat-accumulating properties. For accumulation of heat in the night-time and for giving off the heat under determined conditions, the radiator according to the invention comprises a heat-insulating container (1) which has an inner space (2) and one or more heat accumulation vessels (3) therein. One or more electrical heating elements (4) for heating the heat accumulation vessels (3) are also housed in the container. The container (1) is surrounded by a jacket (5), so that an air gap (6) is formed around the container (1). A regulator (7) is adapted, in dependence on the ambient temperature of the radiator, to first open one or more passages (8, 9) between the inner space (2) of the container (1) and the air gap (6) in response to the ambient temperature of the radiator having fallen to a first level and to subsequently open at least one passage (10) between the air gap (6) and the surroundings of the radiator in response to the ambient temperature of the radiator having dropped fallen to a second level lower than the first level by moving at least one damper along the outer side of the jacket (5).

9 Claims, 5 Drawing Figures

ELECTRICALLY HEATED RADIATOR WITH HEAT ACCUMULATING PROPERTIES

BACKGROUND OF THE INVENTION

This invention relates to a radiator with heat accumulating properties.

The degree of utilization of electric power being low in the night-time, it will be advantageous for both private and national economy to shift over a major part of the power consumption to the night-time. The marginal cost is low at night and a better utilization of resources in the night-time also implies an additional contribution to the total exploitation of energy. However, there are no electrically heated radiators with optimum heat accumulating properties apt to give off the requisite heat during the requisite period in the daytime.

The object of the present invention therefore is to provide an electrically heated radiator with optimum heat accumulating properties so that the requisite heat can be given off during the requisite number of hours in the daytime These properties are achieved according to the invention in that the radiator presents the characteristic features defined by the appended claims.

The electrically heated radiator comprises a heat insulating container having an inner space which houses one or more heat-accumulation vessels. Also housed within the inner space are one or more electrical heating elements for heating the heat-accumulation vessels. The heat-insulating container is surrounded by a jacket so that an air gap is formed around the heat insulating container. The electrically heated radiator also comprises a regulator which is adapted to open one or more passages between the inner space and the air, and/or between the air gap and the environment.

The regulator comprises a thermostat device which senses the ambient temperature of the radiator, a mechanism controlled by the thermostat device which cooperates with one or more valves adapted to open passages between the inner space and the air gap. The valve also cooperates with one or more dampers adapted to open passages provided in the jacket between the air gap and the surroundings of the radiator. The regulator, during a heating period for heating the heat-accumulation vessels, is adapted to control the valve and the damper to keep the passages between the inner space and the air gap, as well as the passages between the air gap and the surroundings of the radiator, closed.

After the heating period, the regulator opens the valve that maintains the damper in a closed position so that the passages between the air gap and the radiator surroundings are closed. This permits a flow of warm air from the inner space to the air gap and prevents air flow from the air gap to the surroundings. If the ambient temperature continues to decrease, this is sensed by the thermostat and the passages between the inner space and the air gap, as well as the passages between the air gap and the surroundings, are open. This leads air from the inner space and from the air gap into the surroundings.

A valve seat may be provided beneath the valve. The regulator controls movement of the valve in relation to the valve seat to successively open the passages between the inner space of the container and the air gap. The regulator also controls movement of the damper along the outer side of the jacket so as to open a plurality of passages distributed along the jacket between the air gap and the surroundings of the radiator.

The radiator may also comprise a control bar with a toothed segment that cooperates with the gear of a screw mounted into the valve. Thus, the valve is moved with respect to the valve seat when the screw is turned by the control bar. The mechanism further may comprise a dog which cooperates with perforated dampers in order to move the dampers with respect to holes in the jacket after disengagement of the valve from the screw.

One may provide a regulator at both the top and the bottom of the radiator for opening passages provided at both the top and bottom ends of the radiator.

Further, the heat-insulating container may be provided with insulating material, such as mineral wool, disposed between an inner wall and an outer wall of this heat-insulating container.

The heat accumulation vessels housed in the heat-insulating container may be steel tubes arranged in one or more rows in the inner space of the heat-insulating container.

The electric heating element may be comprised of heating coils embedded in silumin which is in contact with the heat accumulation vessels.

Finally, the air gap may contain one or more electric heating elements.

BRIEF DESCRIPTION OF THE DRAWINGS

For a better understanding, the invention will now be described in more detail with reference to the accompanying drawings in which.

DETAILED DESCRIPTION OF THE PREFERRED EMBODIMENT

Figure 1:
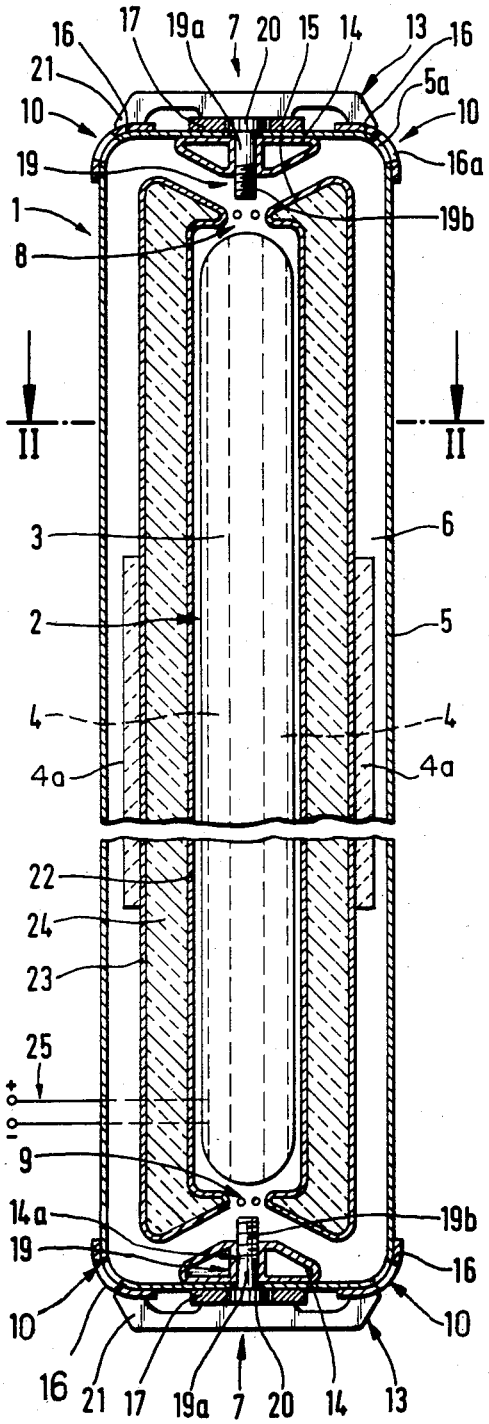
FIG. 1 shows a vertical section of a radiator according to the invention.
Figure 2:
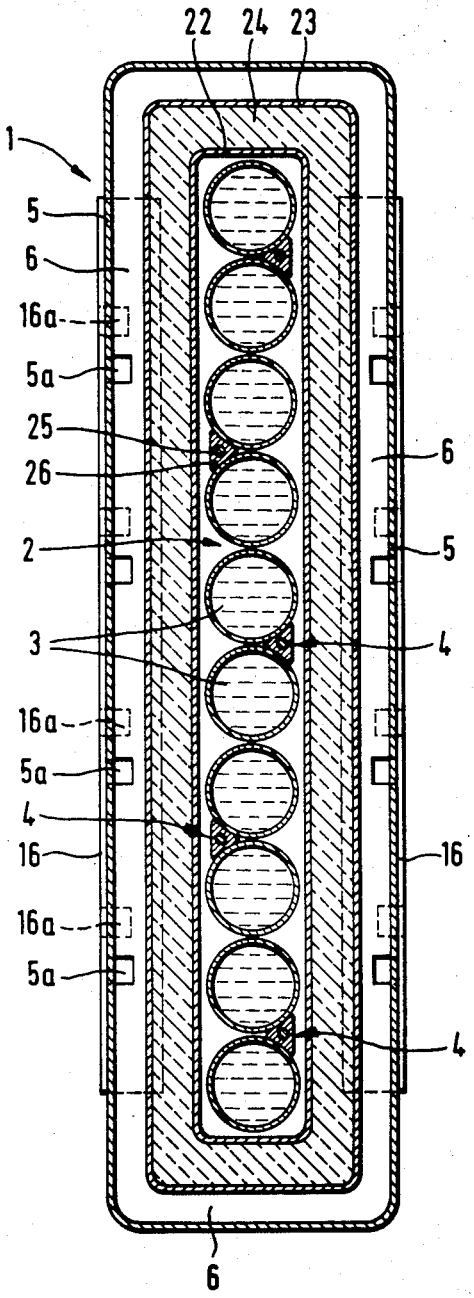
FIG. 2 shows a section on the line II—II in FIG. 1 with openings 16*a* and holes 5*a* being out of register.
Figure 3:
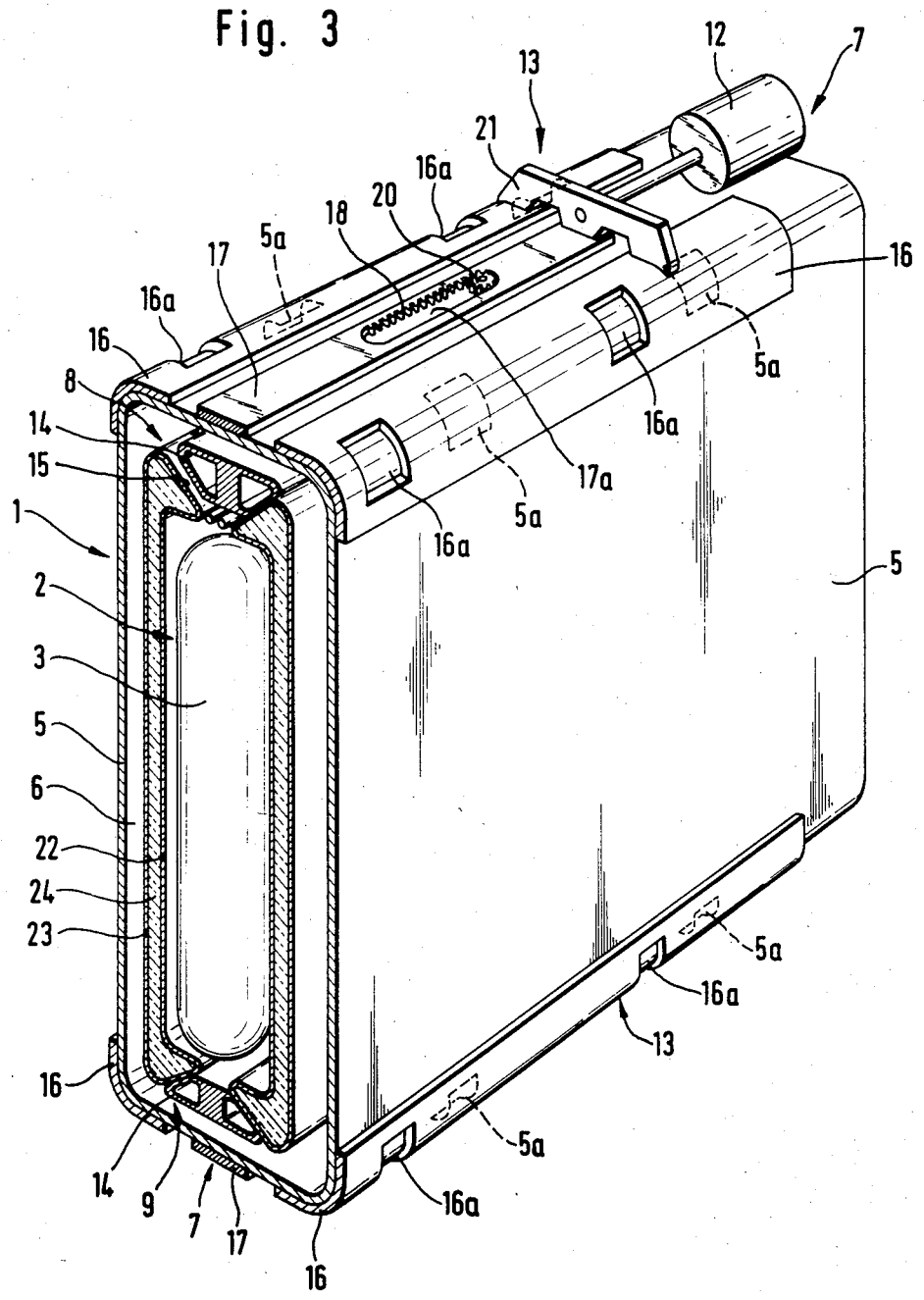
FIG. 3 shows part of the radiator in a perspective view, with a regulator set in a fully closed position.
Figure 4:
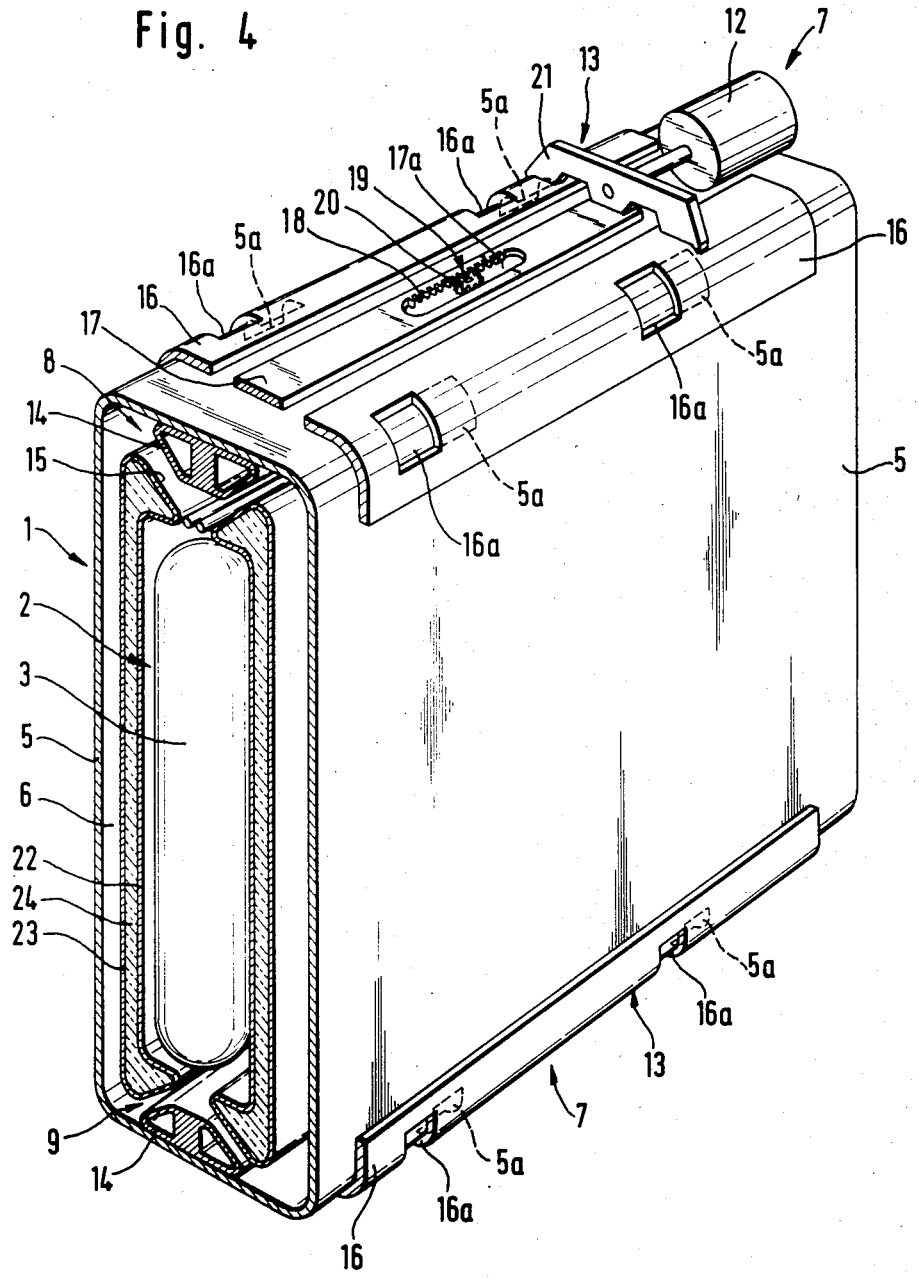
FIG. 4 shows part of the radiator with the regulator set in a partially open position.
Figure 5:
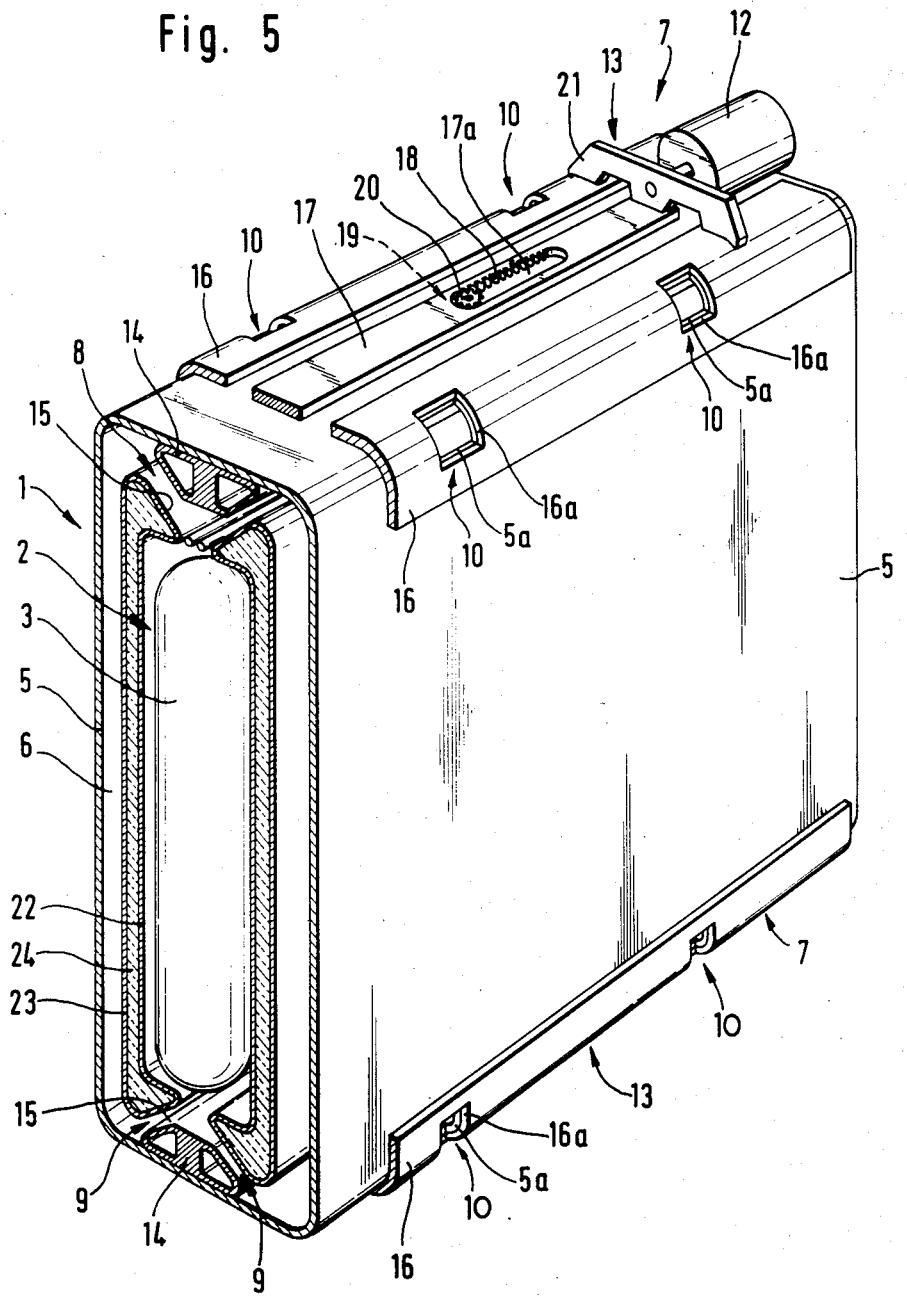
FIG. 5 shows part of the radiator with the regulator set in a fully open position.

The radiator illustrated in FIG. 1 substantially consists of a heat insulating container 1 which has an inner space 2 with a number of heat accumulation vessels 3 therein, and of a number of electric heating elements 4 for heating the heat accumulation vessels 3. The container 1 is surrounded by a jacket 5 so that an air gap 6 is formed around the container 1. The space 2 can communicate with the air gap 6 via an upper passage 8 and a lower passage 9. These passages are in the form of elongated openings in the container. The air gap 6 in turn can communicate with the surroundings of the radiator via passages 10 at the top and bottom of the jacket 5, the passages 10 being in the form of holes in said jacket 5. The passages 8, 9 and 10 can be closed and opened by means of an upper and a lower regulator 7. Said regulators 7 are adapted simultaneously to open the passages 8, 9 between the inner space 2 and the air gap 6 when the ambient temperature of the radiator has fallen to a certain level. Moreover, the regulators 7 are adapted to simultaneously open the passages 10 between the air gap 6 and the surroundings of the radiator when the ambient temperature of the radiator has fallen to a still lower level. To perform these functions, each regulator 7 has a thermostat device illustrated in FIGS. 3–5 which, by displacement of one or more mechanisms 13, moves the valve means 14 in relation to valve seats 15 in the walls of the container 1 and further moves the dampers 16 along the outer side of the jacket 5. Each mechanism 13 has a control bar 17 which cooperates with the thermostat device 12 and has an oblong hole 17*a* with a toothed segment 18. A screw means 19 projects into the oblong hole 17*a* and presents a gear 20 which cooperates with the toothed segment 18. The screw means 19 extends downward into a threaded hole 14*a* in the valve means 14 and adjacent the gear 20. Said screw means has a non-threaded smooth portion 19*a* and a threaded end portion 19*b* connecting on to said first portion 19*a*. The mechanism 13 further has a dog 21 via which the thermostat device 12 adjusts two dampers 16. Said dampers engage the outer side of the jacket 5 and are movably mounted in guides (not shown). Each damper has a number of openings 16*a* which by displacement of the damper 16 can be caused to register with holes 5*a* in the jacket 5 to establish connection via the passages 10.

In the night-time, the electric circuit 25 diagrammatically illustrated in FIG. 1 is closed whereby the electric heating elements 4 are set in operation for heating the heat accumulation medium in the heat accumulation vessels 3. All passages 8, 9, and 10 leading outwards from the inner space 2 are thereby closed. When full accumulation has been attained, the heat transmission in the daytime takes place in the first phase over the total insulation, which means that the heat in the inner space 2 must pass through the inner and outer walls 22 and 23, the insulating material 24, the air gap 6 and the outer jacket 5. The regulators 7 now occupy the position shown in FIG. 3. When the temperature in the surroundings of the radiator falls the thermostat device 12 is caused to move the regulators 7. Thus, the toothed segment 18 of the control bar 17 turns the gear 20 so that the screw means 19 rotates, whereby the threaded end portion 19*b* moves the valve means 14 away from its valve seat 15 because said threaded end portion cooperates with the threaded hole 14*a* in the valve means 14. The passages 8, 9 between the inner space 2 and the air gap 6 are thereby simultaneously opened so that heat can flow from the inner space 2 out into the air gap 6. At the same time as the valve means 14 is moved the dampers 16 are also moved, but not to such an extent that their openings 16*a* register with the holes 5*a* in the jacket 5. Therefore, the heat cannot as yet escape from the air gap 6 into the surroundings. The setting of the regulators 7 during this phase will be apparent from FIG. 4.

At a further fall of the ambient temperature, the regulators 7 will be moved on in the same direction. As a result, the valve means 14 will be disengaged from the threaded end portion 19*b* of the screw means 19 since the valve means 14 will be positioned opposite the non-threaded smooth portion 19*a* of the screw means 19 and thus be disengaged from the threaded end portion 19*b*. At the continued movement of the control bar 17 towards the open position, the valve means 14 will not thus move in relation to its valve seat 15, whereas the dampers 16 continue their movement until their openings reach the holes 5*a* in the jacket 5 and simultaneously but slowly register with them until the passages 10 are fully open. As a result, heat can flow directly from the inner space 2 via the passages 8, 9 and the passages 10 outwards to the region surrounding the radiator. As a result of one regulator 7 being arranged at the bottom of the radiator, air can flow into the air gap from below and warm air can flow out of the air gap at the top, which implies that an advantageous air circulation is brought about in the air gap 6. It should be observed that the lower regulator 7 in FIG. 1 is shown in open position to illustrate the positions taken in such a case by the component parts thereof. In the operation of the radiator the upper regulator and the lower regulator are simultaneously open and simultaneously closed, as will appear from FIGS. 3, 4 and 5.

The radiator described thus has three heat emission phases, viz. a first heat emission phase when the heat must flow through various wall portions, insulating materials and air gaps, a second heat emission phase when the heat can flow past several walls and insulating materials while it must pass through an outer jacket, and a third heat emission phase in which the heat can flow directly outwards into the surroundings without having to pass through any wall portions or insulating materials.

It may also be mentioned that the heat accumulation vessels 3 suitably are of steel material and that they contain a heat accumulation medium in the form of liquid, preferably water, the liquid volume in the vessels being so chosen that the liquid substantially remains in the liquid phase when maximally heated. The electrical heating elements 4 preferably have heating coils 25 embedded in Silumin material 26 (87% aluminum, 13% silicon) which is in contact with the heat accumulation vessels 3. To improve, in certain cases, the circulation in the air gap 6 and/or to have the ability to supply the radiator with additional heat, one or more electric heating elements 4*a* may be arranged in the air gap 6.

The invention should not be considered limited to the embodiment described and shown, as it can be varied within the scope of the appended claims. Thus, in special cases it may be sufficient to allow heat to escape from the inner space 2 to the air gap 6 via the passages 8, 9 and to give off heat from the air gap 6 via the jacket 5 instead of allowing the heat to escape through the passages 10. Another conceivable alternative is not to allow the heat from the inner space to flow to the air gap via the passages 8, 9 but only via the walls of the container 1, while the heat from the air gap 6 can flow out into the surroundings via the passages 10. It is also conceivable to provide the radiator with more wall portions and air gaps, if need be, and the regulator may be of a configuration other than that illustrated in the drawings. The jacket 5 may wholly or partly be made of wood to provide a pleasing appearance of the radiator.

I claim:

1. An electrically heated radiator with heat-accumulating properties, comprising:

a heat-insulated container (1) having an inner space (2) with at least one heat accumulation vessel (3) therein, and at least one electrical heating element (4) for heating said at least one heat accumulation vessel (3);

a jacket (5) surrounding the container so that an air gap (6) is formed around the container (1);

a regulator (7) responsive to the ambient temperature of the radiator, for opening at least one passage (8, 9) in the container for establishing heat flow communication between the inner space of the container (1) and the air gap (6) and at least one passage 10 in said jacket for establishing heat flow communication between the air gap (6) and the surroundings of the radiator;

wherein the regulator (7) is adapted first to open at least one passage (8, 9) between the inner space (2) of the container (1) and the air gap (6) in response to the ambient temperature of the radiator having substantially fallen to a first level, and second to open also at least one passage (10) between the air gap (6) and the surroundings of the radiator in response to ambient temperature of the radiator having fallen to a second level lower than said first level; and wherein the regulator (7) comprises at least one thermostat device (12) which by displacing at least one mechanism (13) moves at least one valve means (14) in relation to a valve seat (15) on the container (1) to successively open the passages (8, 9) between the inner space (2) of the container (1) and the air gap (6), and further move one or more dampers (16) along an outer side of the jacket (5) to successively open at least one passage (10) disposed in the jacket between the air gap (6) and the surroundings of the radiator.

2. A radiator as claimed in claim 1, wherein said at least one mechanism (13) comprises a control bar (17) having a toothed segment (18) cooperating with a gear (20) of a screw means (19) which is screwed into the valve means (14) cooperating with the valve seat (15) of the container (1) so that the valve means (14) is moved in relation to the valve seat (15) when the screw means (19) is turned by displacement of the control bar (17) along the gear (20) of the screw means (19), said at least one mechanism (13) further having a dog (21) which cooperates with said dampers (16) to move said dampers in relation to holes (5*a*) defining said at least one passage in the jacket (5) also after the valve means (14) has been disengaged from the screw means (19).

3. A radiator as claimed in claim 2, wherein a regulator (7) is arranged both at the top and the bottom of the radiator to open passages (8, 9, 10) provided both at the top and the bottom thereof.

4. A radiator as claimed in claim 3, wherein the container (1) is provided with insulating material (24) between an inner wall (22) and an outer wall (23) thereof.

5. A radiator as claimed in claim 4, wherein said insulating material is comprised of mineral wool.

6. A radiator as claimed in claim 4, wherein at least one heat accumulation vessel (3) contains a heat accumulation medium in the form of a liquid, the liquid volume being chosen so that the liquid substantially remains in a liquid phase when maximally heated.

7. A radiator as claimed in claim 6, wherein a plurality of heat accumulation vessels (3) are arranged in at least one row in the inner space (2) of the container (1), and wherein said vessels comprise steel tubes.

8. A radiator as claimed in claim 7, wherein at least one electric heating element (4) is in contact with at least one heat accumulation vessel (3).

9. A radiator as claimed in claum 8, wherein at least one electrical heating element (4*a*) is disposed in the air gap (6).

* * * * *